US011448212B2

(12) United States Patent
Rigosi

(10) Patent No.: US 11,448,212 B2
(45) Date of Patent: Sep. 20, 2022

(54) GEARED VOLUMETRIC MACHINE

(71) Applicant: CASAPPA S.P.A., Collecchio (IT)

(72) Inventor: Manuel Rigosi, Collecchio (IT)

(73) Assignee: CASAPPA S.P.A., Collecchio (IT)

( * ) Notice: Subject to any disclaimer, the term of this patent is extended or adjusted under 35 U.S.C. 154(b) by 0 days.

(21) Appl. No.: 17/265,089

(22) PCT Filed: Sep. 6, 2019

(86) PCT No.: PCT/IB2019/057514
§ 371 (c)(1),
(2) Date: Feb. 1, 2021

(87) PCT Pub. No.: WO2020/053720
PCT Pub. Date: Mar. 19, 2020

(65) Prior Publication Data

US 2021/0310485 A1 Oct. 7, 2021

(30) Foreign Application Priority Data

Sep. 13, 2018 (IT) ..... 102018000008557

(51) Int. Cl.
*F03C 2/00* (2006.01)
*F03C 4/00* (2006.01)
(Continued)

(52) U.S. Cl.
CPC ..... *F04C 2/102* (2013.01); *F04C 2/107* (2013.01); *F04C 15/0026* (2013.01);
(Continued)

(58) Field of Classification Search
CPC ..... F04C 2/102; F04C 2/107; F04C 15/0026; F04C 15/0042; F04C 2230/103; F04C 2240/54; F04C 2240/56
See application file for complete search history.

(56) References Cited

U.S. PATENT DOCUMENTS 2,527,941 A 10/1950 Lauck et al.
2,624,287 A 1/1953 Ilyin
(Continued)

FOREIGN PATENT DOCUMENTS

CN 101558218 A 10/2009
CN 103062044 A 4/2013
(Continued)

*Primary Examiner* — Theresa Trieu
(74) *Attorney, Agent, or Firm* — Pearne & Gordon LLP

(57) ABSTRACT

A geared volumetric machine including:

a first and a second door; the second door operating at a greater pressure than the first door; one from between the first and second door being an inlet door of a fluid into the volumetric machine and the other door being an outlet door;

a first cogged wheel in turn including a first and a second lateral flank;

a second cogged wheel enmeshing with the first cogged wheel;

a first and a second abutment between which the first cogged wheel is interposed and that respectively face the first and the second lateral flank of the first cogged wheel;

a first grooved pathway which at least in a first angular position of the first cogged wheel connects a first and a second zone, the first zone including at least one of the compartments which is in communication with the second door.

9 Claims, 4 Drawing Sheets

(51) Int. Cl.

| | |
|---|---|
| ***F04C 2/00*** | (2006.01) |
| ***F04C 2/10*** | (2006.01) |
| ***F04C 2/107*** | (2006.01) |
| ***F04C 15/00*** | (2006.01) |

(52) U.S. Cl.
CPC .... *F04C 2230/103* (2013.01); *F04C 2240/54* (2013.01); *F04C 2240/56* (2013.01)

(56) References Cited

U.S. PATENT DOCUMENTS 2,997,960 A * 8/1961 Kimijima ..... F04C 15/0042 418/79
3,474,736 A * 10/1969 Lauck ..... F04C 15/0026 418/74
3,909,165 A * 9/1975 Laumont ..... F04C 15/0026 418/102
4,090,820 A * 5/1978 Teruyama ..... F04C 15/0026 418/79
4,239,468 A * 12/1980 Smith ..... F04C 2/086 418/132
4,392,798 A * 7/1983 Bowden ..... F04C 15/0088 418/102
8,920,147 B2 12/2014 Guenther
9,297,378 B2 3/2016 Ando et al.
2008/0166254 A1* 7/2008 Jordan ..... F04C 15/0026 418/78
2010/0150762 A1 6/2010 Guenther
2012/0156080 A1 6/2012 Laetzel et al.
2013/0101448 A1 4/2013 Ando et al.

FOREIGN PATENT DOCUMENTS

DE 1293599 B 4/1969
DE 102009012916 A1 9/2010

* cited by examiner

GEARED VOLUMETRIC MACHINE

TECHNICAL FIELD

The present invention relates to a geared volumetric machine. It is typically a pump but could also be a motor.

PRIOR ART

Geared pumps are known comprising cogged wheels with helical teeth. Two types of axial forces are generated on helical teeth: a mechanical one due to the interaction between the teeth and a hydrostatic one generated by the pressure acting in the compartments between the teeth. The axial force on the drive wheel is given by the sum of these two components, while on the driven wheel such two components are subtracted. Such axial force, considering the prolonged and pulsating stress, can reduce the efficiency, determine reliability problems or however generate premature wear on one of the two shims placed to the side of the cogged wheels, in particular at the cogged drive wheel. In order to completely or partially contrast such thrust (and reduce wear) a piston is known which exerts a balancing force on the cogged wheel, acting in a second direction opposite to the first.

In an alternative solution, there is a groove having a width of 2 millimetres on the shims and which extends according to an arc of a circle remaining at a constant distance from a rotation axis of one of the cogged wheels.

A fluid at high pressure is conveyed inside such groove, which exerts a counter-force in part the axial thrust induced by the helical teeth.

OBJECT OF THE INVENTION

The object of the present invention is to provide a volumetric machine that allows the manufacturing costs to be reduced, optimising the components. A further object of the present invention is that of minimising wear and therefore maximising the efficiency and reliability of a volumetric machine.

The stated technical task and specified objects are substantially achieved by a volumetric machine comprising the technical features disclosed in one or more of the appended claims.

BRIEF DESCRIPTION OF THE DRAWINGS

Further characteristics and advantages of the present invention will become more apparent from the following indicative and therefore non-limiting description of a volumetric machine as illustrated in the appended drawings, in which.

DETAILED DESCRIPTION OF PREFERRED EMBODIMENTS OF THE INVENTION

Figure 1:
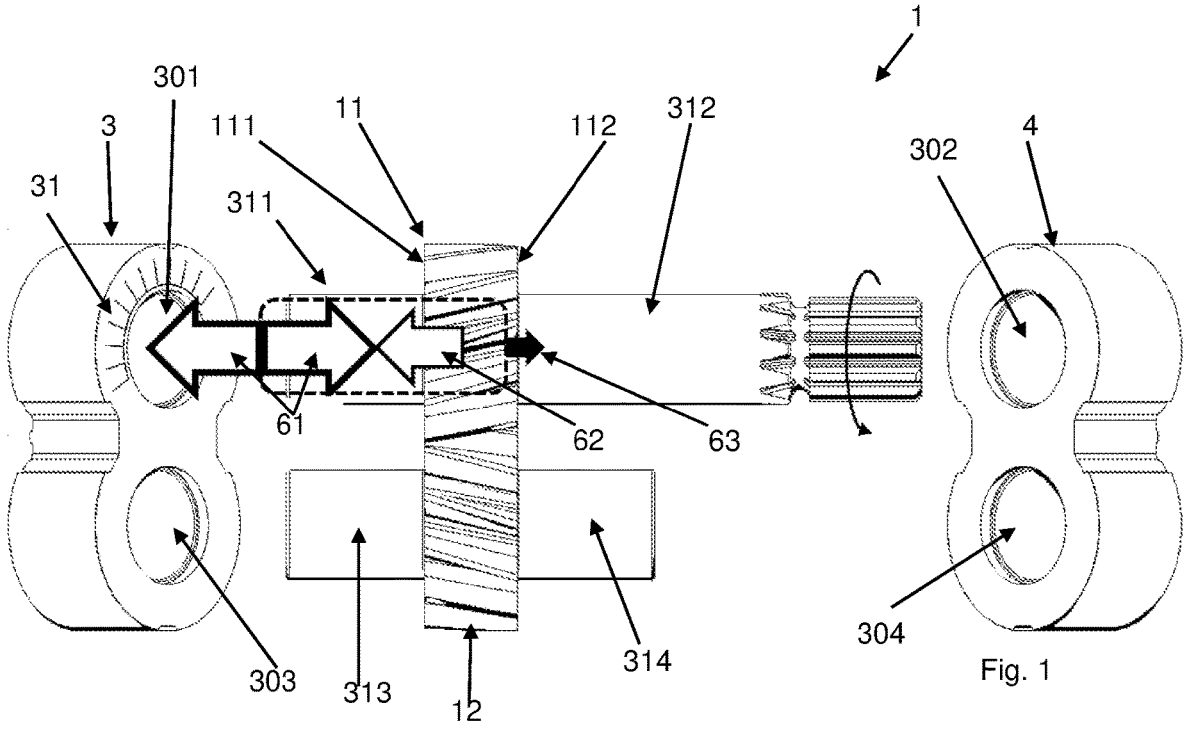
FIG. 1 shows an exploded view of a machine according to the present invention.

In the accompanying figures reference number 1 denotes a volumetric gear machine. Typically it is a pump, but it could also be a motor or a reversible pump-motor machine. Such machine 1 comprises a first cogged wheel 11. The first cogged wheel 11 in turn comprises a first and a second lateral flank 111, 112. The first and the second flank 111, 112 are oriented transversally, preferably orthogonally, to a rotation axis of the first wheel 11.

The machine 1 comprises a second cogged wheel 12 enmeshing with the first cogged wheel 11. The first cogged wheel 11 comprises a plurality of teeth between which a plurality of compartments 9 are interposed. Such compartments 9 are destined to house the teeth of the second wheel 12 (during operation). A rotation axis of the first cogged wheel 11 and a rotation axis of the second cogged wheel 12 are parallel. The first and the second wheel 11, 12 may be externally alongside each other. Appropriately the first cogged wheel 11 is the drive wheel and the second cogged wheel 12 is the driven wheel. The machine 1 comprises a casing in which the first and the second cogged wheels 11, 12 are housed.

The machine 1 further comprises a first and a second abutment 3, 4 between which the first cogged wheel 11 is interposed. The first and the second abutment 3, 4 enable the abutment of the first cogged wheel 11 and the axial positioning thereof. The first abutment 3 may be a single monolithic body or an assembly of more parts. This is repeatable for the second abutment 4. The first and the second abutment 3, 4 are respectively a first and a second shim. The first and the second abutment 3,4 respectively face the first and the second lateral flank 111, 112 of the first cogged wheel 11. Appropriately, also the second cogged wheel 12 is interposed between the first and the second abutment 3, 4.

Advantageously the first abutment 3 defines a seat 301 in which a first stretch 311 of a support shaft of the first cogged wheel 11 is inserted. Appropriately the second abutment 4 defines a housing seat 302 of a second stretch 312 of the support shaft of the first cogged wheel 11 (the first and the second stretch 311, 312 lie on opposite sides with respect to the first cogged wheel 11). Appropriately the first and the second abutment 3, 4 also define two seats 303, 304 into which a first stretch 313 of a support shaft of the second cogged wheel 12 and a second stretch 314 of the support shaft of the second wheel 12 are inserted, respectively.

The machine 1 comprises a first and a second door 91, 92. The second door 92 operates at a higher pressure than the first door 91; one from between the first and the second door 91, 92 being an inlet door into the volumetric machine 1 of a fluid (incompressible, typically oil) and the other being an outlet door of the fluid from the volumetric machine 1; in particular in the case in which the volumetric machine 1 is a pump the inlet door will be the first door 91 and the outlet door will be the second door 92. In the event in which the volumetric machine 1 is a motor the inlet door will be the second door 92 and the outlet door will be the first door 91. In that case the rotation direction of the first and the second wheel 11, 12 is inverted with respect to the solution in which the machine is a pump (the forces diagram of FIG. 1 still remaining unaltered). The first and the second door 91, 92 allow the inlet and outlet of fluid from a compartment housing the first and the second wheel 11, 12.

The volumetric machine 1 comprises a first grooved pathway 31 which at, least in a first angular position of the first cogged wheel 11 (advantageously in every angular position of the first wheel 11) connects a first and a second zone 51, 52. The first zone 51 comprises/is at least one (preferably each) of the compartments 9 which is in communication with the second door 92. The first zone 51 therefore affects at least one of the compartments 9 at high pressure (preferably all the compartments 9 at high pressure); compartment at high pressure means a compartment in which the instantaneous mean pressure is comprised between 50-100% of the instantaneous mean pressure of the second door 92. Appropriately the first zone 51 comprises at least one (preferably all) of the compartments 9 in connection with the second door 92 through a track having a minimum cross section of greater area than that of a ball with a diameter of 2 millimetres. Appropriately, the first zone 51 comprises at least one (preferably all) of the compartments 9 in connection with the second door 92 through:

- a track that allows the passage of a ball (fictitious test element) with a diameter greater than 1 mm; or
- a hydraulic connection with an equivalent diameter equal to 1 millimetre.

The second zone 52 is the locus of the points interposed between the first abutment 3 and the first flank 111 (i.e. the part of the first abutment 3 covered by the first wheel 11). The second zone 52 is called "passageway".

The track that connects one of the compartments 9 to the second door 92 can comprise, for example, a groove 93 formed on an outer perimeter edge of the first or of the second abutment 3, 4. Such track may possibly simply be an interface defined between one of the compartments 9 that opens (radially) directly into a zone facing the second door 92. Such track can also comprise a micro-incision being part of the first grooved pathway 31.

Figure 7:
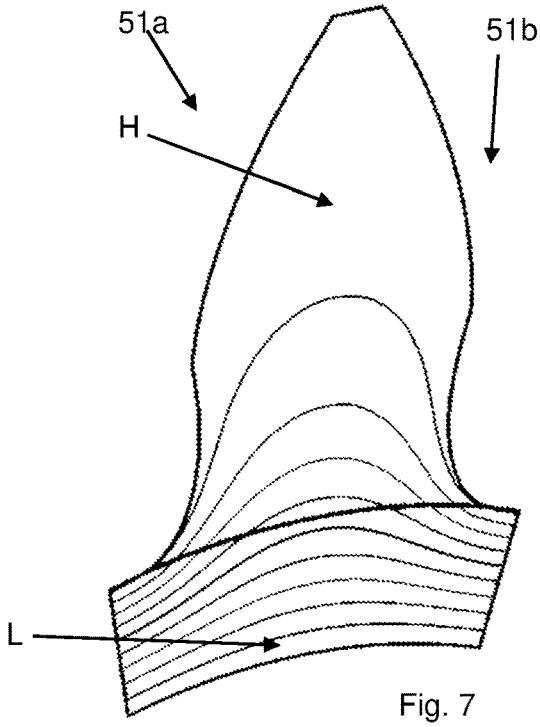
FIG. 7 shows a distribution of pressure in the absence of the expedient of FIG. 6.

If, with respect to a reference tooth, the left and right compartments (51*a* and 51*b* of FIG. 7) are connected to the high pressure and the seats 301, 302, 303, 304 of the support shafts work at low pressure (i.e. the support shafts do not have a forced sustenance with fluid under pressure), the pressure distribution in the passageway 52 is that of FIG. 7: note the isobaric curves from the high pressure zone H to the low pressure zone L.

Figure 6:
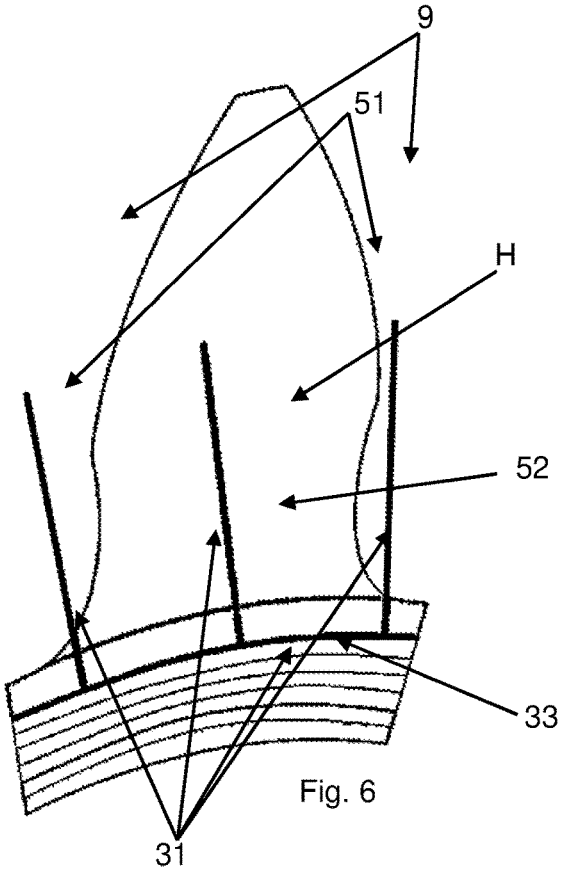
FIG. 6 shows a distribution of pressure induced by an expedient according to the present invention.

The first grooved pathway 31 has the objective of modifying the above pressure distribution. In FIG. 7 (where the expedient according to the present invention is absent) a plurality of isobaric curves can be identified between a zone H at higher pressure and a zone L at lower pressure whereas in FIG. 6 (according to the present invention) such isobaric curves have been concentrated below the arc 33 and the zone H at high pressure is much larger. The effect of increasing the surface wetted by oil at high pressure has the consequence of generating an extra force 61 that tends to separate the first abutment 3 and the first flank 111.

The first abutment 3 can comprise such first grooved pathway 31 that faces the first flank 111 or, in an alternative solution not illustrated, the first flank 111 can comprise at least a first grooved pathway 31 that faces the first abutment 3. The first grooved pathway 31 is part of the distribution means in a second zone 52 of an incompressible fluid (at high pressure) present in a first zone 51. In this way it is possible to modify the distribution of pressure of FIG. 7 obtaining that of FIG. 6. The first grooved pathway 31 therefore performs a driving channel function. In fact, it transfers pressure from the first to the second zone 51, 52. In this way, the pressure increases at a passageway present between the teeth of the first wheel 11 and the first abutment 3 moving it closer/equalising it with the (greater) pressure that is recorded at the compartments 9 between the teeth. In particular, the increase in pressure due to such expedient is particularly clear at the base of the teeth of the first wheel 11.

The first grooved pathway 31 comprises a stretch having a passage section with a surface area less than 1 $mm^2$, preferably less than 0.75 $mm^2$ even more preferably less than 0.5 $mm^2$. Such stretch can also envisage changes in direction that are more or less marked but without interruptions. Advantageously, such stretch extends for a greater length than at least 25% of the length of the pitch circle radius of the first cogged wheel 11. Advantageously said stretch affects at least 90%, preferably 100%, of the first grooved pathway 31. Preferably such stretch of the first grooved pathway 31 has a depth comprised between 0.07 and 0.7 millimetres. Such stretch of the first grooved pathway 31 has a width comprised between 0.03 and 0.7 millimetres. Appropriately the depth and/or the width of the first grooved pathway 31 are constant. It can therefore be defined as a micro-slit. A reduced width of said first grooved pathway 31 allows the surface that is subtracted from the contact between the first flank 111 and the first abutment 3 to be minimised. Therefore, it is possible to keep the support surface between the first abutment 3 and the first flank 111 high, consequently not reducing/penalising the hydrostatic and hydrodynamic sustenance capacity at the interface between the first abutment 3 and the first flank 111.

The first grooved pathway 31, at the second zone 52, at least partly extends between a radially nearer position and a radially more distant position from a rotation axis of the first cogged wheel 11.

Advantageously, for at least half of the angular pathway of the first wheel 11 the first grooved pathway 31 connects the first and the second zone 51, 52.

Appropriately, in each angular position of the first wheel lithe first grooved pathway 31 connects the first and the second zone 51, 52.

Even more preferably in each angular position of the first wheel lithe first grooved pathway 31 connects the first zone 51 and the passageway placed between:

- each tooth of the first wheel 11 in communication with the second door 92 (or at least 75% of the teeth of the first wheel 11 in communication with the second door 92); and
- the first abutment 3.

Possibly the machine 1 can comprise a plurality of grooved pathways 31, 310 which in combination, in each angular position of the first wheel 11, connect the first zone 51 and the fluid passageways placed between:

- each tooth of the first wheel 11 in communication with the second door 92 (or at least 75% of the teeth of the first wheel 11 in communication with the second door 92); and
- the first abutment 3.

Appropriately, each of said grooved pathways 31, 310 at the second zone 52, at least partly extends between a radially nearer position and a radially more distant position from a rotation axis of the first cogged wheel 11.

Appropriately, the first and second cogged wheels 11, 12 are cogged wheels having helical teeth.

The mechanical interaction between the helical teeth of the first and of the second wheel 11 added to the hydrostatic force generated by the pressure between the compartments 9 of the teeth of the first wheel 11 determines an axial thrust of the first wheel 11 towards the first abutment 3. Such thrust is greater for the drive wheel with respect to the driven wheel (for this reason it was previously indicated that the first cogged wheel 11 is appropriately the drive wheel). The teeth of the first wheel 11 comprise a first tooth that extends between the first and the second abutment 3, 4 from a first end 113 placed at the first flank 111 to a second end 114 placed at the second flank 112. The first end 113 is more advanced than the second end 114 with respect to a rotation direction of the first wheel 11.

Figure 2:
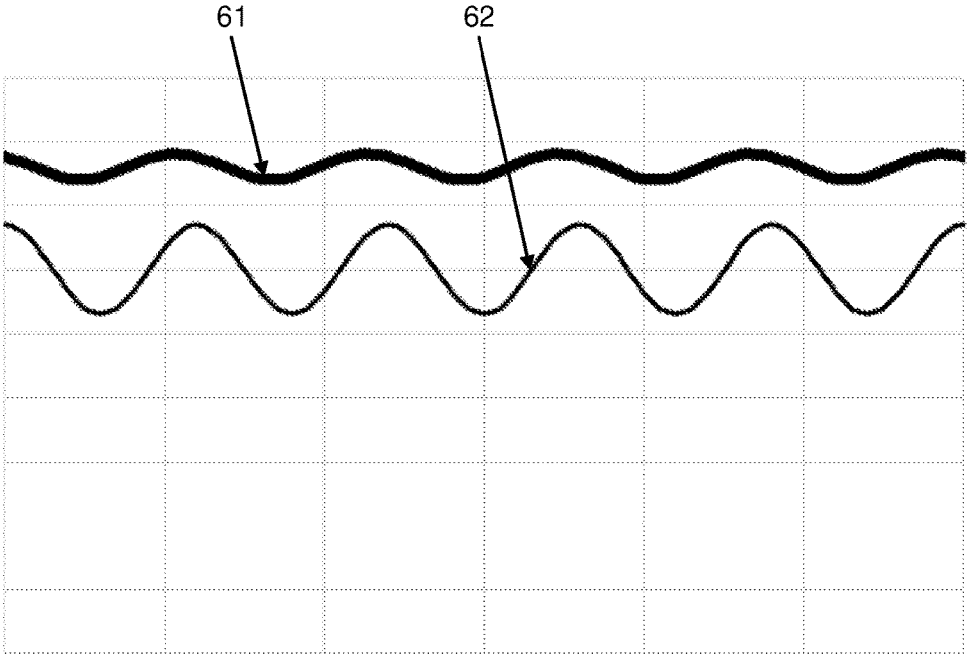
FIG. 2 shows a progression of the forces indicated in FIG. 1.

An axial counter-force (indicated by the reference 61) exerted by the pressure of a fluid interposed between the first flank 111 and the first abutment 3 is greater than the axial thrust (indicated by reference 62) towards the first abutment 3 (induced by the mechanical interaction between the teeth and by the hydrostatic pressure between the compartments 9 of the first wheel 11). Such fluid is the operating fluid processed by the volumetric machine 1 (it is typically oil). As highlighted in FIG. 2, during the rotation of the first and the second cogged wheel 11, 12 there is an oscillation both of the axial thrust 62 and of the axial counter-force 61 exerted by the pressure of the fluid interposed between the first flank 111 and the first abutment 3 (generated for example by the first grooved pathway 31). Despite such oscillation, the counter-force 61 indicated above still remains greater than the axial thrust 62.

Figure 8:
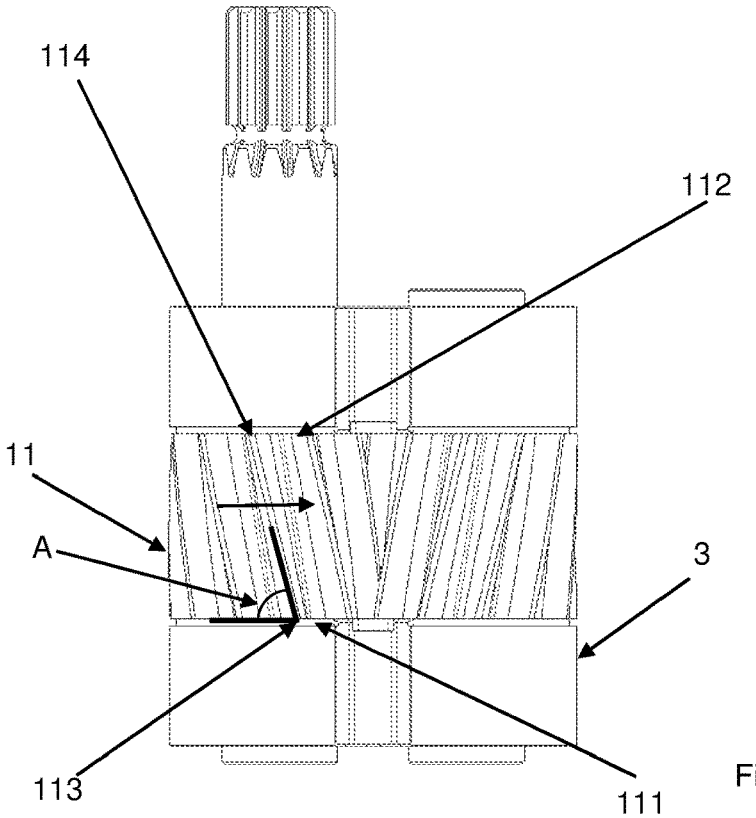
FIG. 8 shows a view from above of the solution of FIG. 1.
Figure 9:
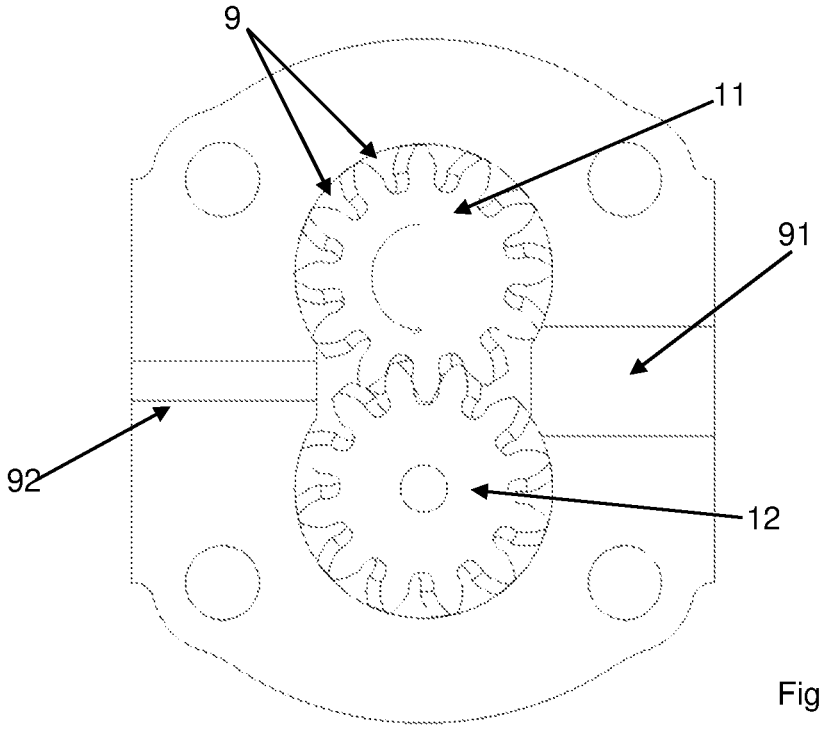
FIG. 9 is a sectional view of a machine according to the present invention.

In fact, it occurs that the axial thrust 62 is oriented against the first abutment 3, at the first end 113. In such first end 113 it occurs that the tooth forms with the first abutment 3 a positive rake angle (A) (see FIG. 8). In other words the acute angle formed by the tooth with the first abutment 3 is turned in the opposite direction to the advancement direction of the first cogged wheel 11. From the theory of cutting tools it is known that a positive rake angle (with equivalent tool compression force) induces a more effective cutting and shaving removal action with respect to a negative rake angle (in the same way, with a fixed compression force between the elements, a positive rake angle can cause more wear and more quickly on the relative sliding surfaces with respect to the case in which there is a negative rake angle). In this case the fact that the axial thrust 62 exerts its action at the positive rake angle is worthy of attention. The use of a counter-force 61 with a greater modulus and opposite direction generated by the presence of pressurised fluid between the first abutment 3 and the first flank 111 ensures that the axial resultant 63 is turned towards the second abutment 4 (where the teeth have a negative rake angle and therefore the wear action on the second abutment 4 is lower).

As previously mentioned, a plurality of grooved pathways 31, 310 are appropriately provided, each comprising at least one portion having a passage section less than 1 $mm^2$, preferably less than 0.5 $mm^2$. The grooved pathways 310 also comprise the first grooved pathway 31.

The grooved pathways 310 are at least in part (preferably all) formed on the first flank 111 and face the first abutment 3 or vice versa they are at least in part formed on the first abutment 3 and face the first flank 111.

What is indicated with reference to the first grooved pathway 31 with reference to the extension or to the width or to the depth of said stretch can be repeated for the grooved pathways 310.

Figure 3:
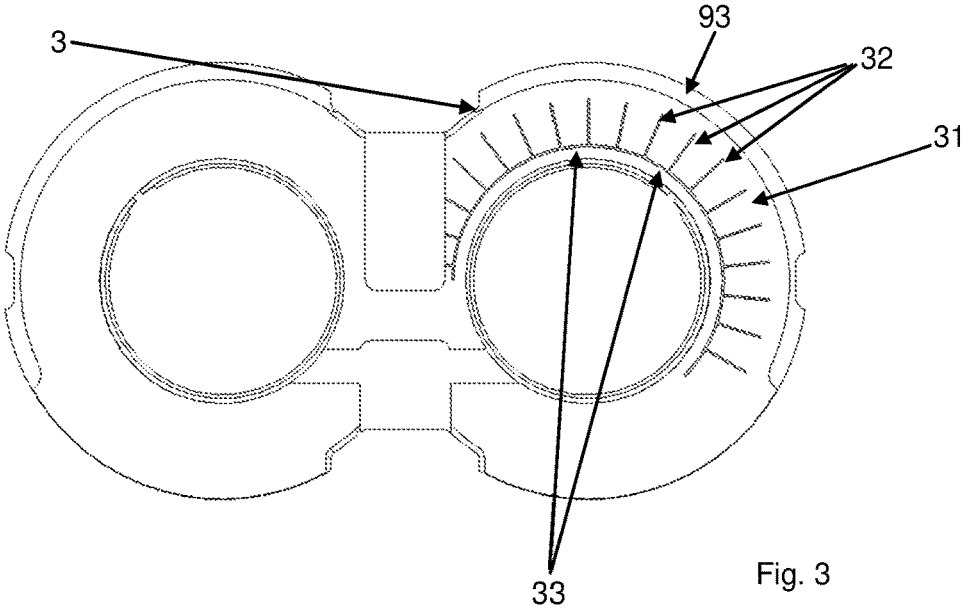
FIG. 3 shows a front view of a component of FIG. 1.
Figure 4:
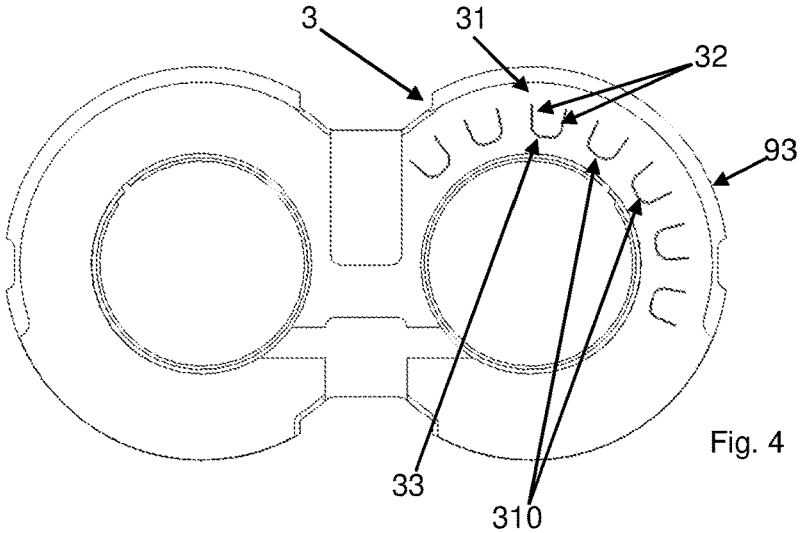
FIGS. 4 and 5 show a front view of a component which is alternative to that of FIG. 3.
Figure 5:
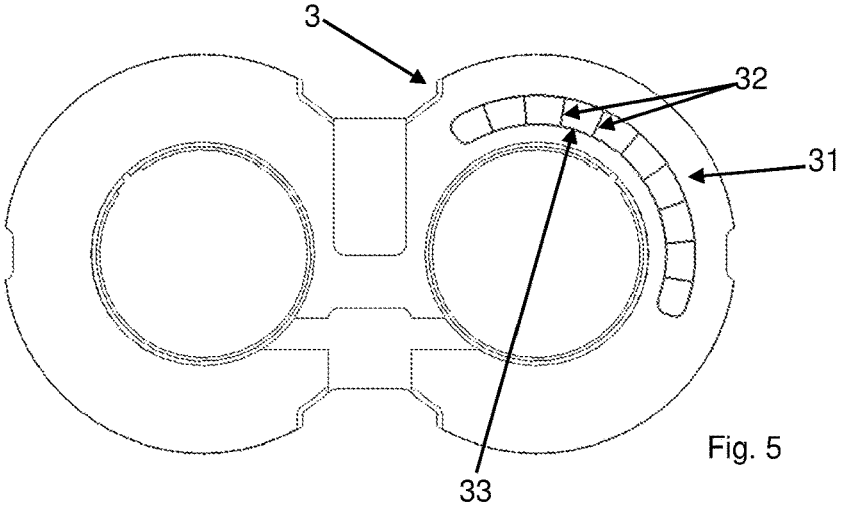

As exemplified in FIGS. 3, 4, 5 the first grooved pathway 31 comprises a plurality of grooves 32 which extend between a radially more internal position and a radially more external position. The grooves 32 are preferably formed in the first abutment 3 and face the teeth of the first cogged wheel 11.

Advantageously the grooves 32 extend in spoke-fashion. Appropriately the spoke-fashion grooves 32 are separated from each other by an angle comprised between 10° and 40°. Preferably the spoke-fashion grooves 32 are separated from each other by an angle that is less than half the angular pitch. The grooves 32 extend from a common channel 33 which extends in an arc (the grooves 32 extend transversally to the channel 33). Appropriately such arc remains at a same distance from the rotation axis of the first cogged wheel 11. The arc is coaxial with the rotation axis of the first cogged wheel 11. Such arc extends for at least 150°, preferably at least 180°. In the preferred solution, for each angular position of the first wheel 11, at least one (preferably a plurality) of the grooves 32 face a zone that is uncovered by the first wheel 11 so as to prime oil from the pressurised compartments 9 and distribute it in zones in which the teeth of the first wheel 11 and the first abutment 3 are superposed. Appropriately the channel 33 extends in a radially more internal position with respect to the lower bottom of the tooth. This allows the pressure exerted by the fluid present therein to be increased.

In the preferred solution, the first grooved pathway 31 is a laser incision. Appropriately, the grooved pathways 310 are laser incisions. Likewise, also said common channel 33 is a laser incision. Such channel 33 has a surface passage section less than 1 $mm^2$ or preferably less than 0.5 $mm^2$.

In a particular constructive solution the grooved pathways 31, 310 as well as extending in a zone of the first abutment 3 opposing the first flank 111 (or in a zone of the first flank 111 opposing the first abutment 3) could also be formed in a zone of the first abutment 3 opposing a flank of the second cogged wheel 12 (or a zone of a flank of the second wheel 12 opposing the first abutment 3). As previously mentioned, also in that case the grooved pathways 31, 310 each have at least one portion having a passage section (cross sectional area) less than 1 $mm^2$, preferably less than 0.5 $mm^2$.

Further subject matter of the present invention is an operating method of a volumetric machine having one or more of the characteristics described hereinabove.

The method comprises the steps of:

generating a layer of pressurised fluid between said first abutment 3 and said first flank 111 redistributing the pressure of said layer of fluid at least through the first grooved pathway 31 (or better the plurality of grooved pathways 310);

exerting by means of said layer of fluid an axial counter-force with a greater and opposite modulus with respect to an axial thrust 62 induced by the sum of the mechanical interaction between the helical teeth of the first and of the second wheel 11, 12 and the hydrostatic force of pressure on the teeth of the first wheel 11.

Further subject matter of the present invention is a method for realising a volumetric machine having one or more of the characteristics described hereinabove. Such realisation method comprises the steps of:

realising the first cogged wheel 11, the second cogged wheel 12, the first and second abutment 3, 4;

carrying out said first grooved pathway 31 (or however said grooved pathways 31, 310), preferably by laser incision on the first cogged wheel 11 or the first abutment 3.

The invention achieves important advantages.

Above all it allows the realisation costs of a volumetric machine to be optimised, at the same time improving the operating reliability and minimising wear. The invention as it is conceived is susceptible to numerous modifications and variations, all falling within the scope of the inventive concept characterising it. Furthermore, all the details can be replaced by other technically equivalent elements. In practice, all the materials used, as well as the dimensions, can be any according to requirements.

The invention claimed is:

1. A geared volumetric machine comprising:

a first and a second door (91, 92); the second door (92) operating at a greater pressure than the first door (91); one from between the first and second door (91, 92) being an inlet door of a fluid into the volumetric machine (1) and the other door being an outlet door of the fluid from the volumetric machine (1);

a first cogged wheel (11) in turn comprising a first and a second lateral flank (111, 112);

a second cogged wheel (12) enmeshing with the first cogged wheel (11); said first cogged wheel (11) comprising a plurality of teeth defining between them a plurality of compartments (9) destined to house teeth of the second cogged wheel (12);

a first and a second abutment (3, 4) between which the first cogged wheel (11) is interposed and which respectively face the first and the second lateral flank (111, 112) of the first cogged wheel (11);

a first grooved pathway (31) which at least in a first angular position of the first cogged wheel connects a first and a second zone (51, 52), the first zone (51) comprising at least one of the compartments (9) which is in communication with the second door (92), the second zone (52) being a locus of points interposed between the first abutment (3) and the first flank (111);

characterised in that said first grooved pathway (31) comprises at least one stretch having a passage section having a surface smaller than 1 $mm^2$;

a) in each angular position of the first cogged wheel (11) said first grooved pathway (31) connects the first zone (51) and each passageway located at a corresponding interface existing between:

i) at least 75% of the teeth of the first cogged wheel (11) in communication with the second door (92) and ii) the first abutment (3);

the first grooved pathway (31) at least partly extends between a radially nearer position and a radially more distant position from a rotation axis of the first cogged wheel (11);

or b) it comprises a plurality of grooved pathways (31, 310) which in combination, in each angular position of the first cogged wheel (11), connect the first zone (51) and each fluid passageway located at an interface existing between:

i) at least 75% of the teeth of the first cogged wheel (11) in communication with the second door (92) and ii) the first abutment (3);

each of said plurality of grooved pathways (31, 310) at the second zone (52), at least partly extends between a radially nearer position and a radially more distant position from a rotation axis of the first cogged wheel (11); said plurality of grooved pathways (31, 310) comprising the first grooved pathway (31).

2. The machine according to claim 1, characterised in that the first and second cogged wheels (11, 12) are cogged wheels having helical teeth; a mechanical interaction between the helical teeth of the first and second cogged wheel (11, 12) added to a hydrostatic force generated by the pressure acting in the compartments (9) of the first cogged wheel (11) determine an axial thrust (62) which pushes the first cogged wheel (11) towards the first abutment (3).

3. The machine according to claim 2, characterised in that the teeth of the first cogged wheel (11) comprise a first tooth which extends between the first and the second abutment (3, 4) from a first end (113) thereof located at the first flank (111) to a second end (114) thereof located at the second flank (112); said first end (113) being more advanced than the second end (114) with respect to a rotation direction of the first cogged wheel (11); an axial counter-force (61) exerted by the pressure of a fluid interposed between the first flank (111) and the first abutment (3) being greater than said axial thrust (62).

4. The machine according to claim 1, characterised in that in each angular position of the first cogged wheel (11) said first grooved pathway (31) connects the first and the second zone (51, 52).

5. The machine according to claim 1, characterised in that said first grooved pathway (31) comprises a plurality of grooves (32) which extend in spoke-fashion from a common channel (33) which extends in an arc.

6. The machine according to claim 1, characterised in that said first grooved pathway (31) is a laser incision.

7. The machine according to claim 1, characterised in that the first zone (51) comprises all the compartments (9) in connection with the second door (92) through a track having a minimum cross section of greater area than that of a ball with a diameter of 2 millimetres.

8. A functioning method of a geared volumetric machine, said geared volumetric machine comprising:

a first and a second door (91, 92); the second door (92) operating at a greater pressure than the first door (91); one from between the first and second door (91, 92) being an inlet door of a fluid into the volumetric machine (1) and the other door being an outlet door of the fluid from the volumetric machine (1);

a first cogged wheel (11) in turn comprising a first and a second lateral flank (111, 112);

a second cogged wheel (12) enmeshing with the first cogged wheel (11); said first cogged wheel (11) comprising a plurality of teeth defining between them a plurality of compartments (9) destined to house teeth of the second cogged wheel (12);

a first and a second abutment (3, 4) between which the first cogged wheel (11) is interposed and which respectively face the first and the second lateral flank (111, 112) of the first cogged wheel (11);

a first grooved pathway (31) which at least in a first angular position of the first cogged wheel connects a first and a second zone (51, 52), the first zone (51) comprising at least one of the compartments (9) which is in communication with the second door (92), the second zone (52) being a locus of points interposed between the first abutment (3) and the first flank (111);

characterised in that said first grooved pathway (31) comprises at least one stretch having a passage section having a surface smaller than 1 $mm^2$;

the first and second cogged wheels (11, 12) being cogged wheels having helical teeth; a mechanical interaction between the helical teeth of the first and second cogged wheel (11, 12) added to a hydrostatic force generated by the pressure acting in the compartments (9) of the first cogged wheel (11) determine an axial thrust (62) which pushes the first cogged wheel (11) towards the first abutment (3);

the teeth of the first cogged wheel (11) comprising a first tooth which extends between the first and the second abutment (3, 4) from a first end (113) thereof located at the first flank (111) to a second end (114) thereof located at the second flank (112); said first end (113) being more advanced than the second end (114) with respect to a rotation direction of the first cogged wheel (11);

an axial counter-force (61) exerted by the pressure of a fluid interposed between the first flank (111) and the first abutment (3) being greater than said axial thrust (62);

a) in each angular position of the first cogged wheel (11) said first grooved pathway (31) connects the first zone (51) and each passageway located at a corresponding interface existing between:

i) at least 75% of the teeth of the first cogged wheel (11) in communication with the second door (92) and ii) the first abutment (3);

the first grooved pathway (31) at least partly extends between a radially nearer position and a radially more distant position from a rotation axis of the first cogged wheel (11);

or b) it comprises a plurality of grooved pathways (31, 310) which in combination, in each angular position of the first cogged wheel (11), connect the first zone (51) and each fluid passageway located at an interface existing between:

i) at least 75% of the teeth of the first cogged wheel (11) in communication with the second door (92) and ii) the first abutment (3);

each of said plurality of grooved pathways (31, 310) at the second zone (52), at least partly extends between a radially nearer position and a radially more distant position from a rotation axis of the first cogged wheel (11); said plurality of grooved pathways (31, 310) comprising the first grooved pathway (31);

the method being characterised in that it comprises the steps of:

generating a layer of pressurised fluid between said first abutment (3) and said first flank (111) by distributing, in the second zone (52), a pressure present in the first zone (51) at least by said first grooved pathway (31);

exerting, by said fluid layer, said axial counter-force (61) having a greater modulus and an opposite direction with respect to the axial thrust (62) induced by the sum of the mechanical interaction between the helical teeth of the first and second cogged wheel (11, 12) and of the hydrostatic force generated by the pressure acting in the compartments (9) of the first cogged wheel (11).

9. A method for realising a geared volumetric machine, said geared volumetric machine comprising:

a first and a second door (91, 92); the second door (92) operating at a greater pressure than the first door (91); one from between the first and second door (91, 92) being an inlet door of a fluid into the volumetric machine (1) and the other door being an outlet door of the fluid from the volumetric machine (1);

a first cogged wheel (11) in turn comprising a first and a second lateral flank (111, 112);

a second cogged wheel (12) enmeshing with the first cogged wheel (11); said first cogged wheel (11) comprising a plurality of teeth defining between them a plurality of compartments (9) destined to house teeth of the second cogged wheel (12);

a first and a second abutment (3, 4) between which the first cogged wheel (11) is interposed and which respectively face the first and the second lateral flank (111, 112) of the first cogged wheel (11);

a first grooved pathway (31) which at least in a first angular position of the first cogged wheel connects a first and a second zone (51, 52), the first zone (51) comprising at least one of the compartments (9) which is in communication with the second door (92), the second zone (52) being a locus of points interposed between the first abutment (3) and the first flank (111);

characterised in that said first grooved pathway (31) comprises at least one stretch having a passage section having a surface smaller than 1 $mm^2$;

a) in each angular position of the first cogged wheel (11) said first grooved pathway (31) connects the first zone (51) and each passageway located at a corresponding interface existing between:

i) at least 75% of the teeth of the first cogged wheel (11) in communication with the second door (92) and ii) the first abutment (3);

the first grooved pathway (31) at least partly extends between a radially nearer position and a radially more distant position from a rotation axis of the first cogged wheel (11);

or b) it comprises a plurality of grooved pathways (31, 310) which in combination, in each angular position of the first cogged wheel (11), connect the first zone (51) and each fluid passageway located at an interface existing between:

i) at least 75% of the teeth of the first cogged wheel (11) in communication with the second door (92) and ii) the first abutment (3);

each of said plurality grooved pathways (31, 310) at the second zone (52), at least partly extends between a radially nearer position and a radially more distant position from a rotation axis of the first cogged wheel (11); said plurality of grooved pathways (31, 310) comprising the first grooved pathway (31);

the method comprises the steps of:

realising the first cogged wheel (11), the second cogged wheel (12), the first and second abutment (3, 4);

carrying out said first grooved pathway (31) by laser incision on the first cogged wheel (11) or the first abutment (3).

* * * * *